US005136282A

United States Patent [19]

Inaba et al.

[11] Patent Number: 5,136,282

[45] Date of Patent: Aug. 4, 1992

[54] FERROELECTRIC LIQUID CRYSTAL APPARATUS HAVING SEPARATE DISPLAY AREAS AND DRIVING METHOD THEREFOR

[75] Inventors: Yutaka Inaba, Kawaguchi; Hiroyuki Kitayama, Sagamihara; Hideyuki Kawagishi, Fujisawa, all of Japan

[73] Assignee: Canon Kabushiki Kaisha, Tokyo, Japan

[21] Appl. No.: 450,817

[22] Filed: Dec. 14, 1989

[30] Foreign Application Priority Data

Dec. 15, 1988 [JP] Japan ..... 63-315056

[51] Int. Cl.[5] ..... G09G 3/36

[52] U.S. Cl. ..... 340/784; 340/805; 340/811

[58] Field of Search ..... 340/784, 709, 801, 803, 340/811, 805; 350/350 S, 333, 332, 350 R; 359/54, 104

[56] References Cited

U.S. PATENT DOCUMENTS

| | | | |
|---|---|---|---|
| 4,485,380 | 11/1984 | Soneda et al. | 340/784 |
| 4,655,561 | 4/1987 | Knobe et al. | 350/350 |
| 4,693,563 | 9/1987 | Harada et al. | 350/350 |
| 4,778,260 | 10/1988 | Ohada et al. | 350/350 |
| 4,844,590 | 7/1987 | Okada et al. | 350/350 S |

*Primary Examiner*—Jeffery A. Brier
*Assistant Examiner*—Regina Liang
*Attorney, Agent, or Firm*—Fitzpatrick, Cella, Harper & Scinto

[57] ABSTRACT

A ferroelectric liquid crystal apparatus of the matrix type which includes a display portion provided with separate display areas which are arranged to be independently driven and a method of driving such a ferroelectric liquid crystal apparatus. In the method, dummy signals are applied to signal electrodes of one of the separate display areas while the other display area is being scanned in order to reduce differences in contrast.

10 Claims, 12 Drawing Sheets

| FIG. 10 A | FIG. 10 B |
|---|---|

FERROELECTRIC LIQUID CRYSTAL APPARATUS HAVING SEPARATE DISPLAY AREAS AND DRIVING METHOD THEREFOR

BACKGROUND OF THE INVENTION

1. Field of the Invention

The present invention relates generally to a ferroelectric liquid crystal apparatus having a display portion formed by a pair of display areas and to a method of driving such a ferroelectric liquid crystal apparatus. More particularly, the present invention relates to a ferroelectric liquid crystal apparatus and driving method in which a predetermined voltage signal is applied to one of the separate display areas during partial rewriting (i.e., partial scanning) of the contents displayed in the other display area for partial scanning of the device so as to reduce the difference in contrast between the display areas. Thereby, improved image display quality is provided.

2. Description of the Related Art

Recently, ferroelectric and TN-type liquid crystal apparatus have been intensively developed for use as image displays. Ferroelectric liquid crystal apparatus are especially advantageous since they provide a memory-like capability, a fast its response speed, and contrast is independent of the duty ratio. Accordingly, it would be desirable to apply the ferroelectric liquid crystal apparatus, for instance, to large-capacity dot matrix apparatus.

FIG. 2 is a schematic view showing one example of the above-described ferroelectric liquid crystal apparatus. As illustrated, this example is provided with a group 1 of scanning electrodes, a group 2 of upper signal electrodes (as viewed in the figure) and a group 3 of lower signal electrodes (as viewed in the figure). The group 1 of scanning electrodes is oppositely spaced apart from groups 2 and 3 of upper and lower signal electrodes with a ferroelectric liquid crystal interposed therebetween. A scanning electrode driving circuit 4 is disposed to apply a voltage to the group 1 of scanning electrodes, while an upper signal electrode driving circuit 5 and a lower signal electrode driving circuit 6 are disposed to apply voltages to the group 2 of upper signal electrodes and the group 3 of lower signal electrodes, respectively. The group 1 of scanning electrodes and the group 2 of upper signal electrodes cross each other to form an upper display area 7, while the group 1 and the group 3 of lower signal electrodes cross each other to form a lower display area 8. In each of the upper display area 7 and the lower display area 8, picture elements are arranged in a matrix form.

FIG. 3 is a schematic diagram showing exemplary forms of applied voltages which act to drive the above-described matrix type display apparatus on a multiplexing basis. As illustrated, scanning pulses 9 are sequentially applied to the group 1 of scanning electrodes, while information signal pulses 10 are sequentially applied in parallel to group 2 or 3 of signal electrodes in synchrony therewith so as to provide a visual image display. If an electric field is not subsequently applied, the last image which was displayed is held. Therefore, the image or information which is required for display on the display apparatus is only rewritten when the necessity for global rewriting arises or when a particular portion (display area) is rewritten.

Although the present inventors carried out the above-described conventional driving method, they found that image contrast markedly differs during a partial-scanning period than during a non-scanning period. This is noticeable, for instance, in the case of the panel-shaped display apparatus of the horizontal split type shown in FIG. 2, which is made of upper display area 7 and lower display area 8 which are separately driven by the groups 2 and 3 of upper and lower signal electrodes. That is, when the upper display area 7 is being scanned in a partial-scanning mode, the contrast of an image displayed in the lower display area 8 (which is not being scanned) is noticeably different from an image displayed in the upper display area 7. This phenomenon, of course, seriously affects the quality of the displayed image. The inventors believe that the difference in image contrast between a scanning period and a non-scanning period arises because, although when no electric field is being applied to a ferroelectric liquid crystal apparatus, the molecules thereof remain oriented in one of two stable states so that the molecules assume the other state if a threshold-exceeding electric field is applied upon the application of an electric field not exceeding the threshold, the molecules nevertheless change their positions more or less, although their state does not substantially change. In FIG. 4, this phenomenon is shown plotted as the relationship between time and a variation in the quantity of light transmitted under cross-nicol conditions as an applied voltage 11 not exceeding the threshold is applied over time. Reference numeral 12 denotes a curve which indicates the corresponding variation in the quantity of transmitted light. It is seen in FIG. 4 that the average quantity of light transmitted during the application of a voltage differs from the quality of light transmitted during application of no voltage. Accordingly, as shown in FIG. 3, during a scanning period, a non-selection voltage (not exceeding the threshold) shown in FIG. 4 is applied to picture elements on non-selected scanning electrodes so that the quantity of light which is transmitted during the scanning period is different than the quantity of light which is transmitted during the non-scanning period. As a result, contrast varies between the scanning and non-scanning periods, as well as between a portion which is being scanned and a portion which is not being scanned. If variation in contrast over time is to be suppressed to a minimum, a refresh scanning (driving) method may be adopted in which information signal pulses are always applied to the signal electrodes so that the contrast is kept constant.

SUMMARY OF THE INVENTION

It is, therefore, an object of the present invention to provide a driving method which enables a ferroelectric liquid crystal apparatus to be partially scanned without causing any serious difference in contrast between the scanned display area and the display area which is not being scanned.

It is another object of the present invention to provide a ferroelectric liquid crystal apparatus adapted to be driven by the above driving method.

To achieve these objects and others, in accordance with one aspect of the present invention, there is provided an improved driving method for a ferroelectric liquid crystal apparatus of the matrix type which has a display portion made up of two separate display areas arranged to be independently driven. In accordance with the improvement, a dummy signal is applied to a signal electrode in one of the separate display areas while the other separate display areas is being scanned. Otherwise, while partial scanning is being performed to partially rewrite the contents displayed in one display area, corresponding scanning lines in the other display area are partially scanned to hold the contents currently displayed therein.

In accordance with another aspect of the present invention, there is provided a ferroelectric liquid crystal apparatus having first and second matrix electrode arrangements, the first matrix electrode arrangement including a first group of scanning electrodes and a first group of signal electrodes, the first groups of scanning electrodes and signal electrodes crossing each other in oppositely spaced relationship, and the second matrix electrode arrangement including a second group of scanning electrodes and a second group of signal electrodes, the second groups of scanning electrodes and signal electrodes crossing each other in oppositely spaced relationship, the second group of signal electrodes being electrically independent from the first group of signal electrodes; a ferroelectric liquid crystal interposed between the first and second groups of scanning electrodes and the first and second groups of signal electrodes; driver circuits for driving the first and second matrix electrode arrangements; and a controller circuit for controlling the driver circuits so as to apply an alternating voltage to the portion of the ferroelectric liquid crystal which is positioned at each intersection point (pixel) of one of the first and second groups of scanning electrodes and a corresponding one of the first and second groups of signal electrodes while the other group of scanning electrodes is being partially scanned, wherein the alternating voltage is at a level which is insufficient to switch that portion of the ferroelectric liquid crystal.

Further objects, features and advantages of the present invention will become apparent from the following detailed description of various embodiments of the present invention with reference to the accompanying drawings.

DESCRIPTION OF THE PREFERRED EMBODIMENTS

Figure 3:
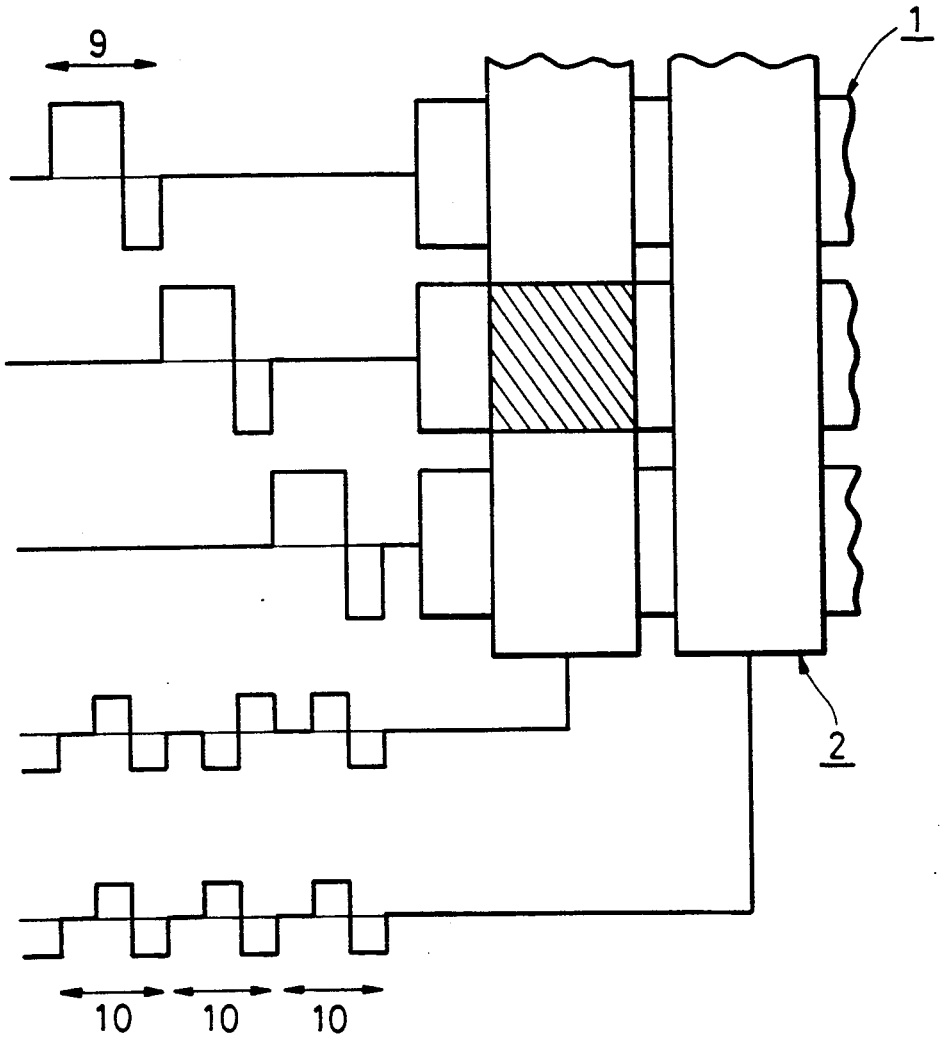
FIG. 3 is a schematic diagram showing a set of drive pulses for driving the apparatus of FIG. 2 on a multiplexing basis.
Figure 4:
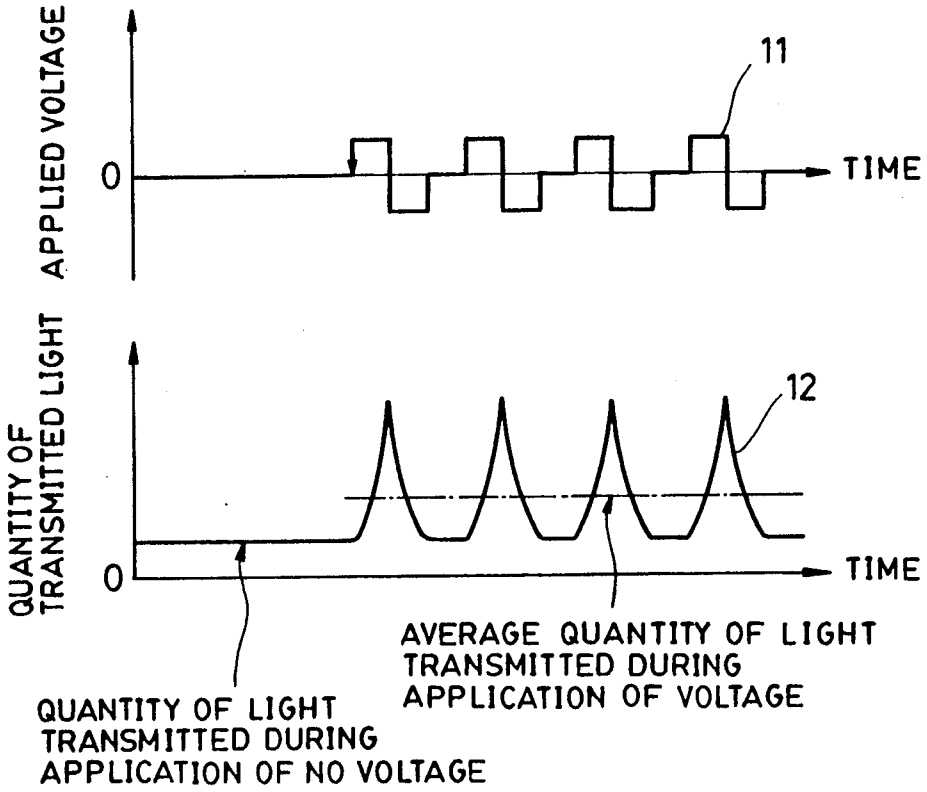
FIG. 4 graphically represents variations in the quantity of transmitted light with respect to voltages not exceeding a threshold voltage of the liquid crystal.

The inventors believe that the difference in image contrast between a scanning period and a non-scanning period arises because, although when no electric field is being applied to a ferroelectric liquid crystal apparatus, the molecules thereof remain oriented in one of two stable states so that the molecules assume the other state if a threshold-exceeding electric field is applied upon the application of an electric field not exceeding the threshold, the molecules nevertheless change their positions more or less , although their state does not substantially change. In FIG. 4, this phenomenon is shown plotted as the relationship between time and a variation in the quantity of light transmitted under cross-nicol conditions as an applied voltage 11 not exceeding the threshold is applied overtime. Reference numeral 12 denotes a curve which indicates the corresponding variation in the quantity of transmitted light. It is seen from FIG. 4 that the average quantity of light transmitted during the application of a voltage differs from the quality of light transmitted during application of no voltage. Accordingly, as shown in FIG. 3, during a scanning period, a non-selection voltage (not exceeding the threshold) shown in FIG. 4 is applied to picture elements on non-selected scanning electrodes so that the quantity of light which is transmitted during the scanning period is different than the quantity of light which is transmitted during the non-scanning period. As a result, contrast varies between the scanning and non-scanning periods, as well as between a portion which is being scanned and a portion which is not being scanned. If variation in contrast over time is to be suppressed to a minimum, a refresh scanning (driving) method may be adopted in which information signal pulses are always applied to the signal electrodes so that the contrast is kept constant.

Figure 5:
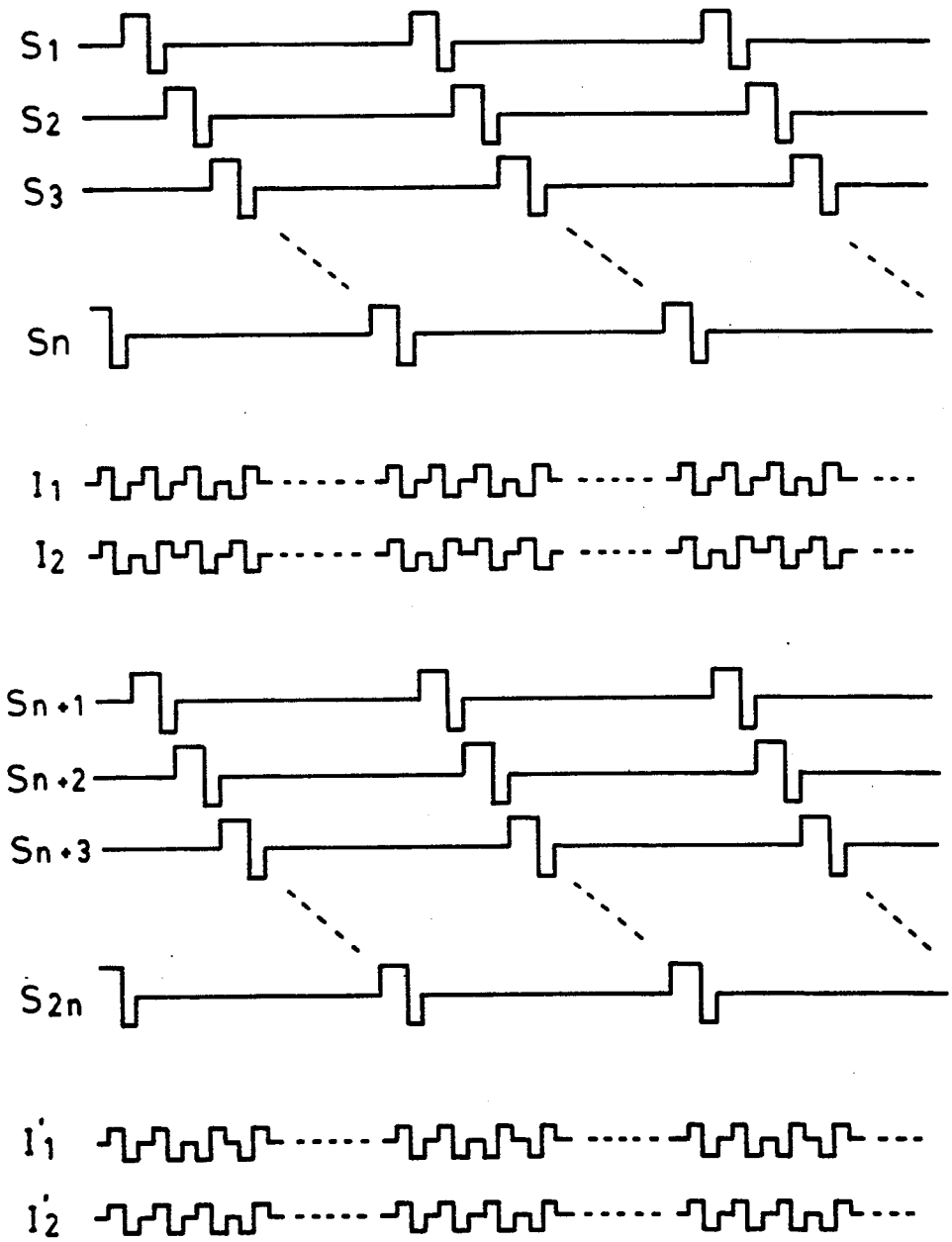
FIG. 5 is a timing chart showing a set of drive pulses in a refresh-driving method for the apparatus of FIG. 2.
Figure 6:
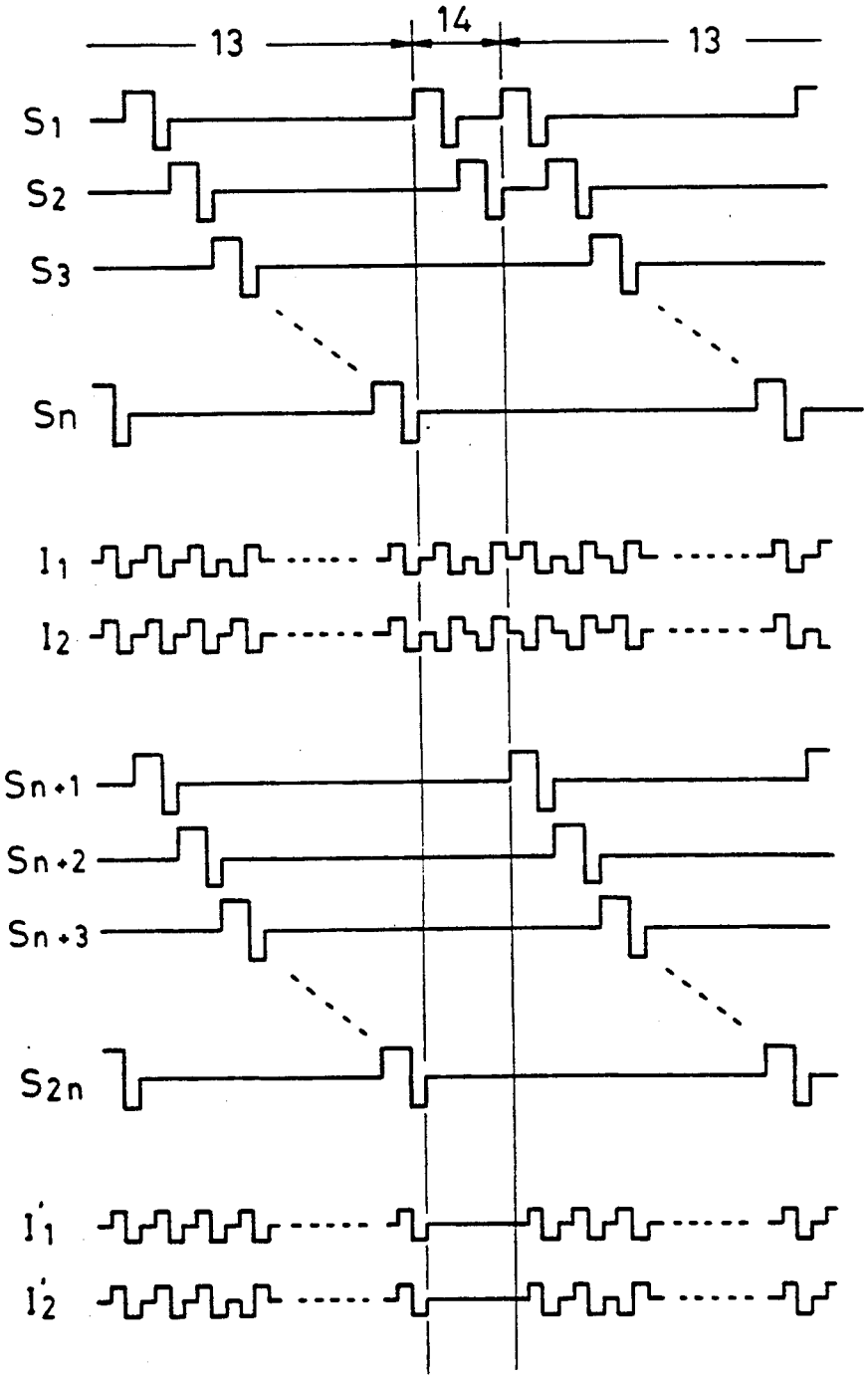
FIG. 6 is a timing chart showing conventional.drive pulses corresponding to a partial-scanning mode.

In a liquid crystal apparatus of the horizontal split type, the upper display area and the lower display area are scanned at the same time. An example of a voltage which is applied to each electrode in the refresh driving method is shown in FIG. 5. In the figure, symbols $S_1$–$S_n$ represent scanning pulses applied to the upper display area, symbols $Sn_{+1}-S_{2n}$ scanning pulses applied to the lower display area, symbols $I_1$ and $I_2$ signal pulses applied to the upper display area, and symbols $I'_1$ and $I'_2$ signal pulses applied to the lower display area. If the necessity for partial rewriting arises while refresh driving is being performed, as shown in FIG. 6, the refresh scanning (period 13) is tempofarily interrupted and partial-scanning occurs (period 14), that is, the contents on scanning lines are rewritten corresponding to the scanning pulses $S_1$ and $S_2$. On the panel-shaped display apparatus of the horizontal split type, the lower display area is not scanned during the partial-scanning period 14 in which the upper display area is scanned. Accordingly, no information signal pulse $I'_1$ or $I'_2$ is applied to any of the signal electrodes of the lower display area and a contrast difference therefore occurs between the upper display area and the lower display area.

In the present invention, however, during the partial-scanning period for which the upper display area is scanned, dummy information signals are applied to the signal electrodes of the lower display area while selecting pulses are not applied to the scanning electrodes of the lower display area. Accordingly, the contents displayed in the lower display area are not changed and the contrast of the image displayed in the lower display area is kept substantially the same as that of the image displayed in the upper display area. Alternatively, during the partial-scanning period in which only the upper display area is scanned, the scanning lines in the lower display area corresponding to the partially scanned lines in the upper display are also scanned for purposes of refreshment. Accordingly, as before, the contrasts of the images displayed in the upper and lower display areas are kept approximately equal.

The above-described partial scanning processe's (for partial rewriting) are disclosed in, for example, U.S. Pat. Nos. 4,655,561 and 4,693,563.

Specific embodiments of the present invention will be explained below with reference to the accompanying drawings.

Figure 1:
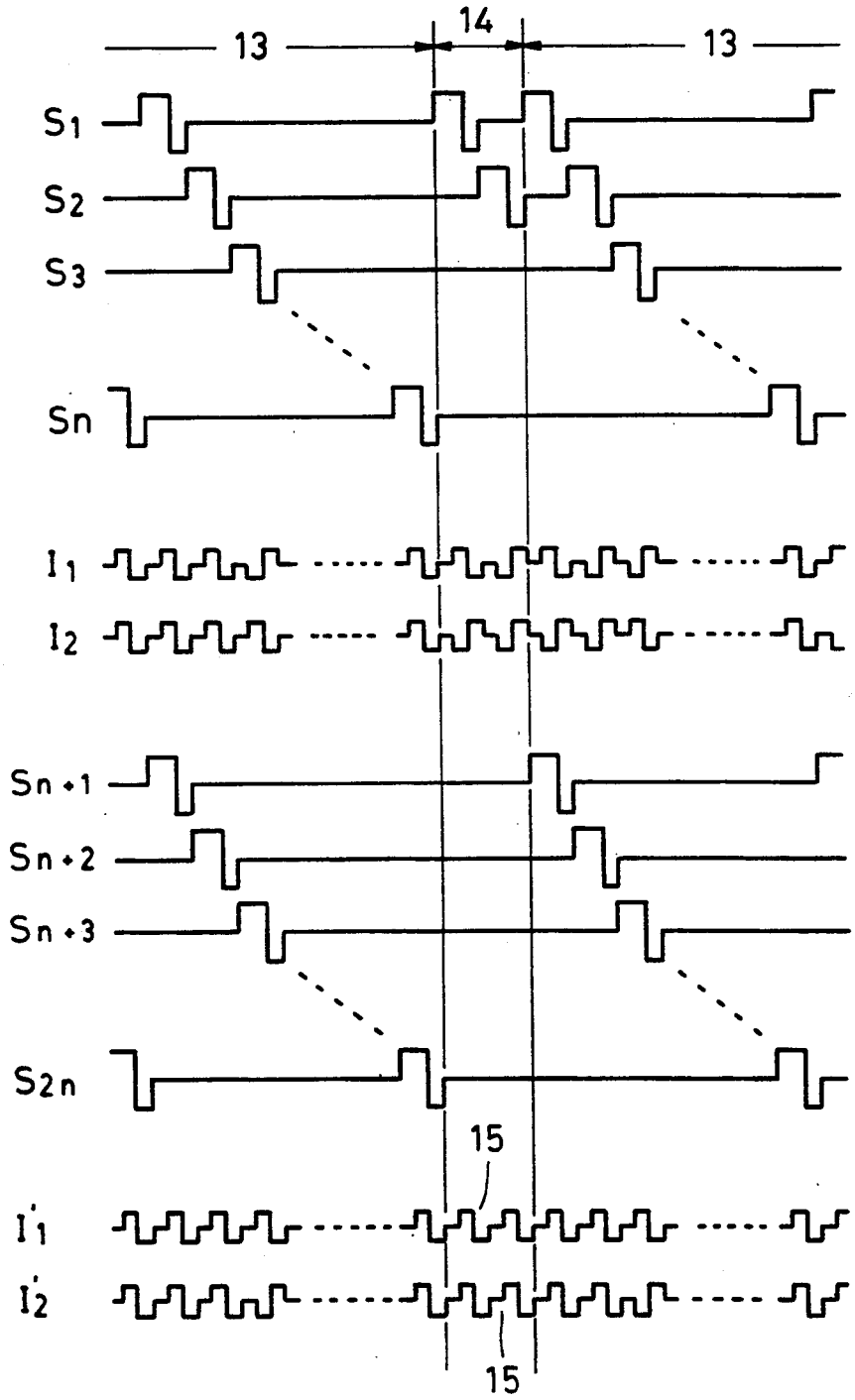
FIG. 1 is a timing chart showing a set of drive pulses in a method of driving a ferroelectric liquid crystal apparatus in accordance with a first embodiment of the present invention.
Figure 2:
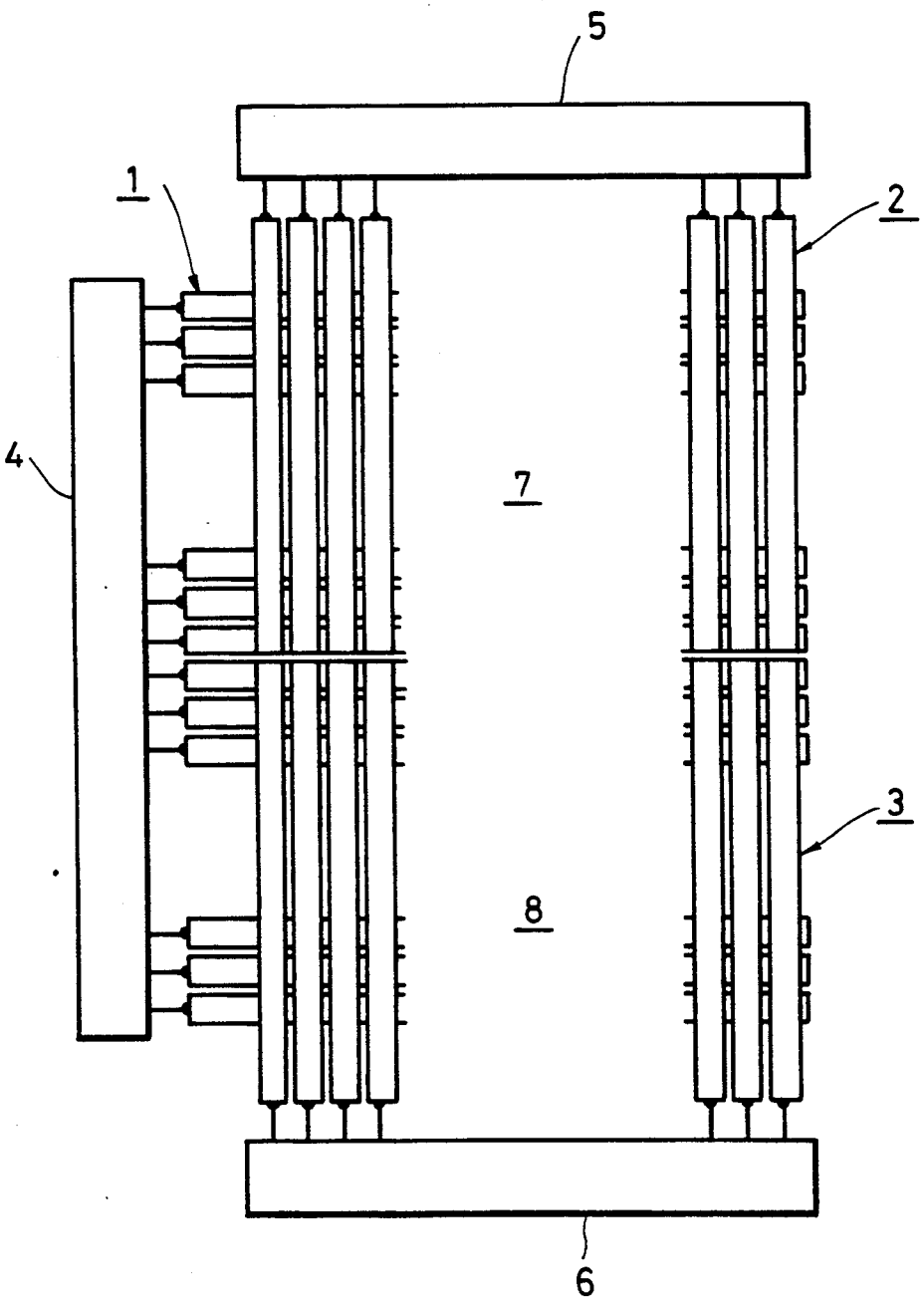
FIG. 2 is a partial schematic view showing a ferroelectric liquid crystal apparatus of the horizontal split type.

FIG. 1 is a timing chart showing applied voltages according to a first embodiment of the present invention. In the following description, the first embodiment is applied to a ferroelectric liquid crystal apparatus of the horizontal split type which consists of two upper and lower display areas, as shown in FIG. 2.

In FIG. 1, as mentioned previously concerning FIG. 5, symbols $S_1$–$S_n$ represent scanning (selecting) pulses applied to the upper display area, symbols $Sn_{+1}$–$S_{2n}$ scanning pulses applied to the lower display area, symbols $I_1$ and $I_2$ signal pulses applied to the upper display area, and symbols $I'_1$ and $I'_2$ signal pulses applied to the lower display area. As in the conventional example shown in FIG. 6, a partial-scanning period 14 during which only the upper display area is scanned is interposed between successive periods 13. allocated for refresh scanning. The difference, however, between FIG. 1 and FIG. 6 is that each of the signal pulses $I'_1$ and $I'_2$ includes a pulse train 15 lasting for a time period corresponding to the partial-scanning period 14 whereby dummy information signals are applied to the signal electrodes of the lower display area. However, since no scanning pulses are applied to any of the scanning electrodes of the lower display area during period 14, the contents of the image displayed in the lower display are do not change. Accordingly, the device is partially scanned and the contrasts of the images displayed in the upper display area and the lower display area are still maintained substantially equal.

Figure 10A:
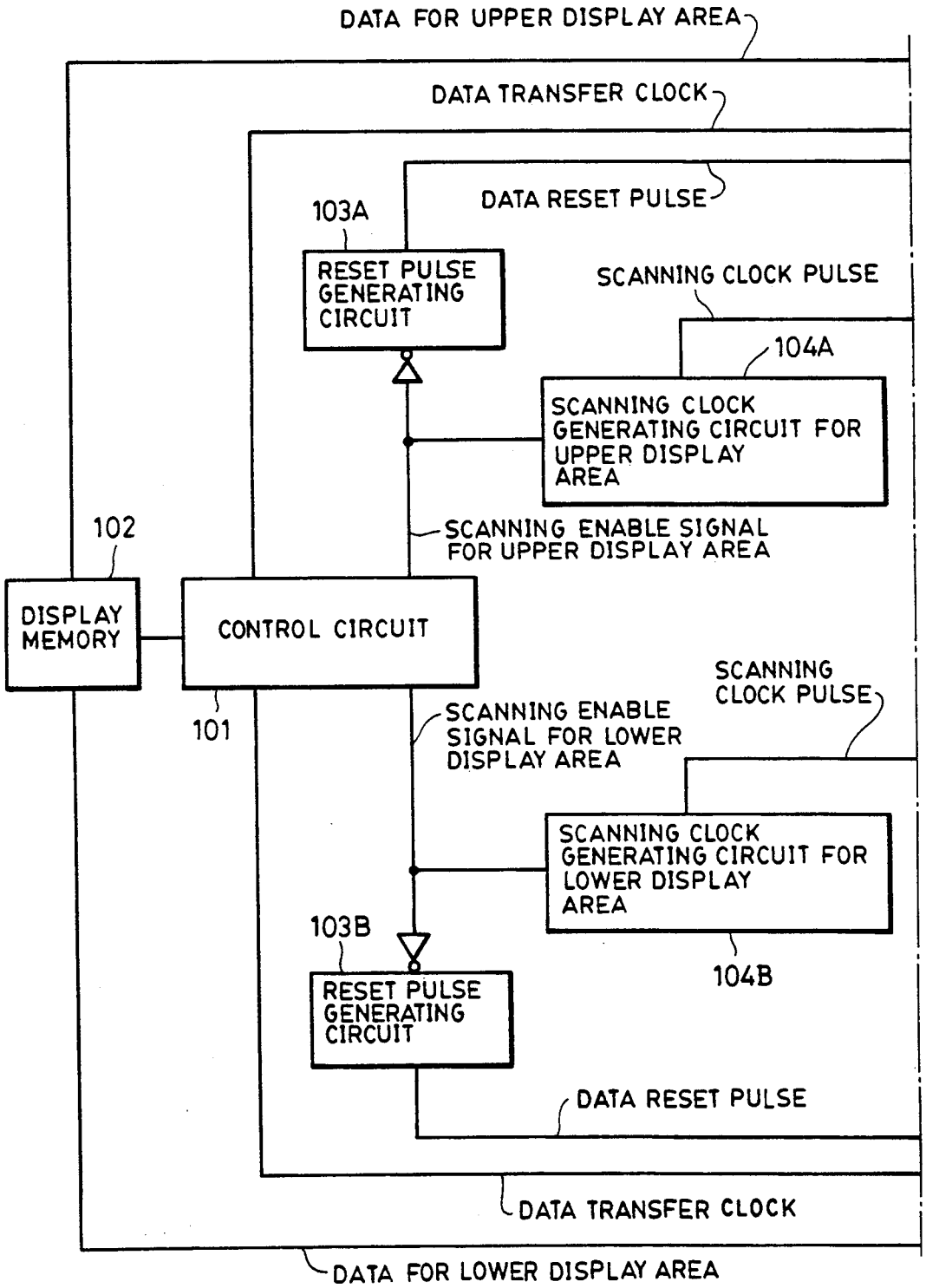
FIGS. 10A–B are block diagrams showing a peripheral circuit for controlling the waveforms of the driving signals used in the first embodiment of the present invention.
Figures 10, 10B:
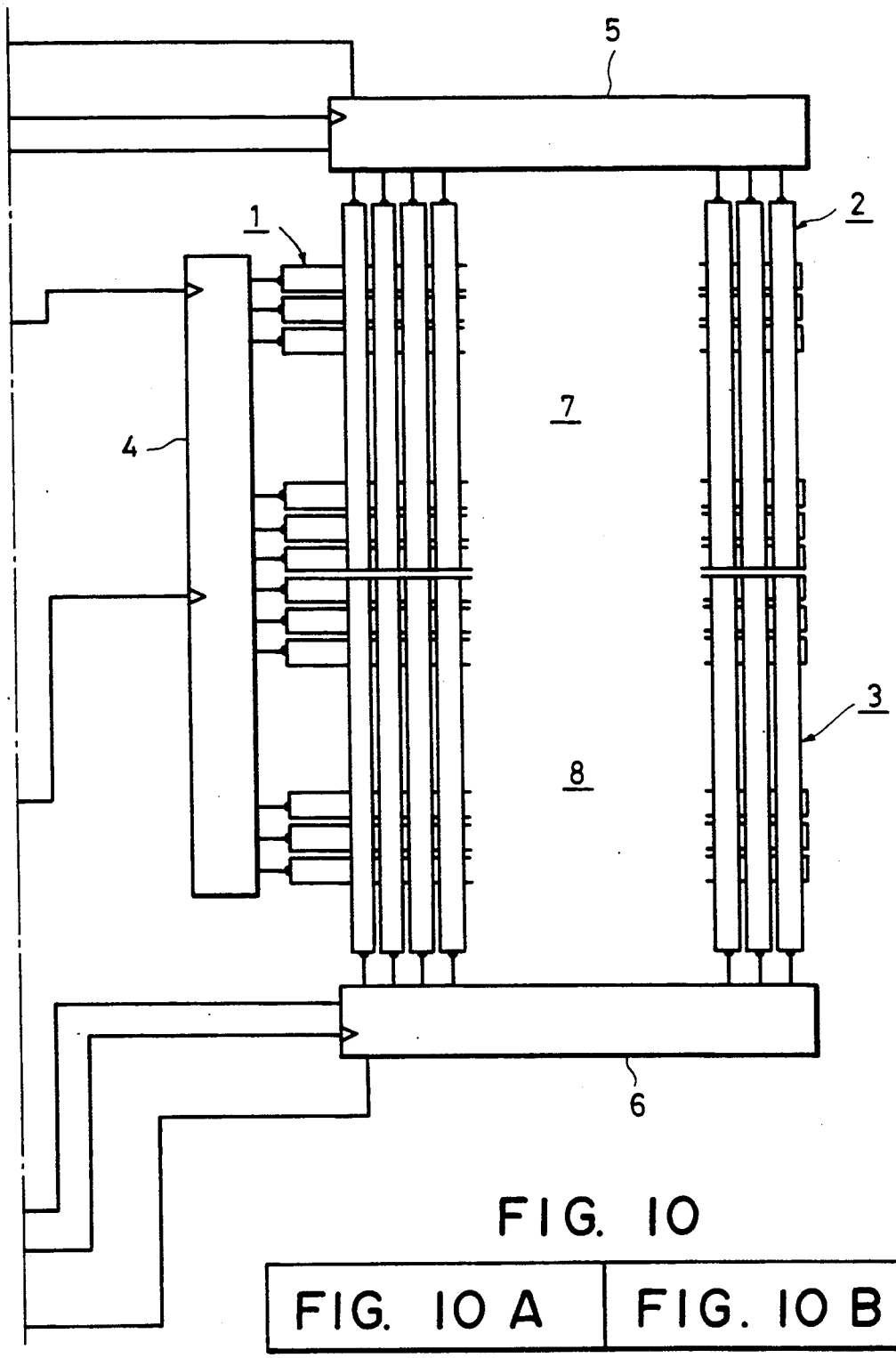
Figure 11:
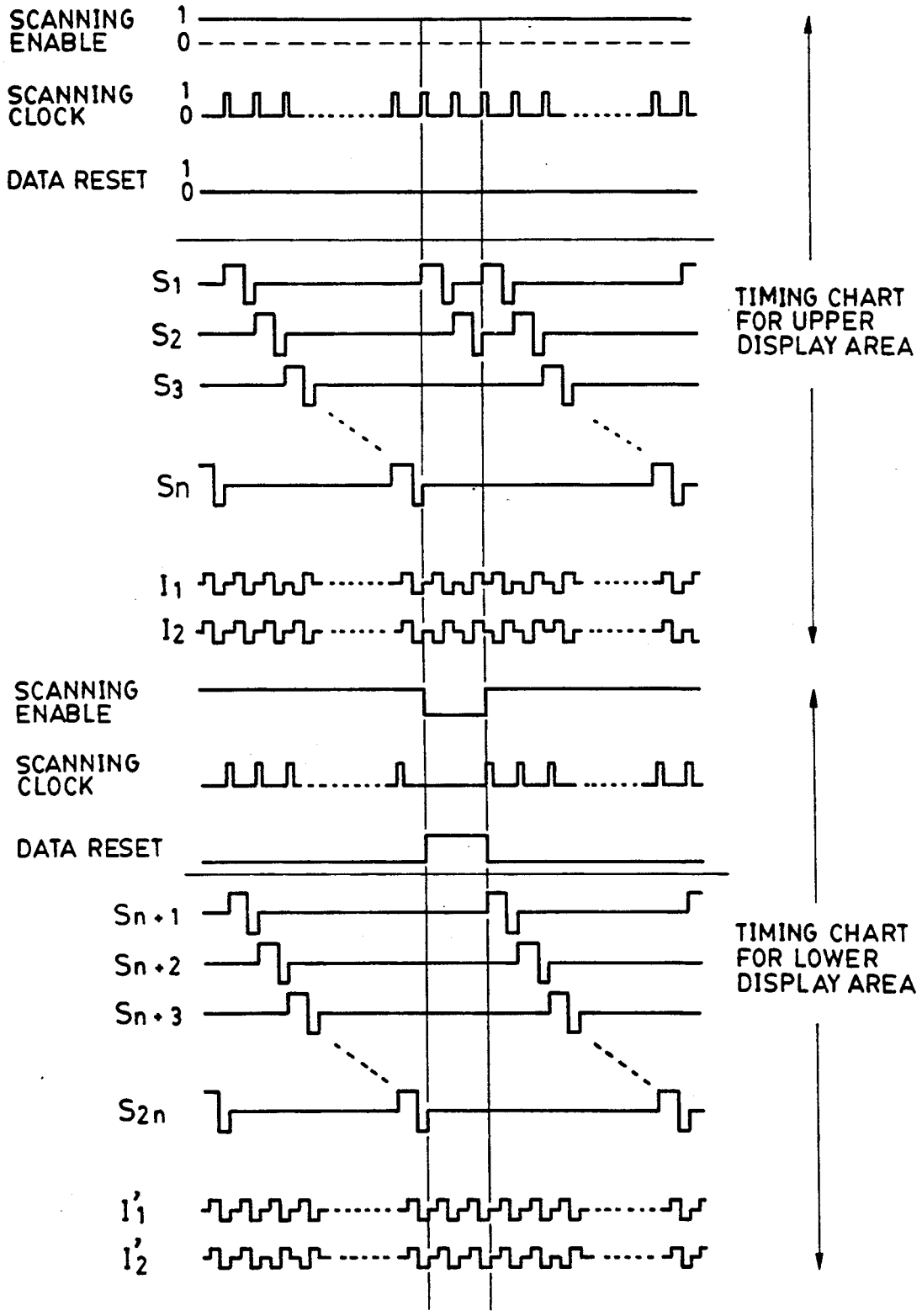
FIG. 11 is a timing chart illustrating the driving signals of FIG. 10.

FIG. 10 is a block diagram showing a peripheral circuit for controlling the waveforms of the driving signals used in the first embodiment of the present invention and FIG. 11 is a timing chart which illustrates the driving signals. The illustrated peripheral circuit includes a control circuit 101, a display memory 102, reset pulse generating circuits 103A and 103B, a scanning clock generating circuit 104A for the upper display area, and a scanning clock generating circuit 104B for the lower display area.

During a normal scanning period,.the control circuit 101 generates scanning enable signals so the upper and lower display areas are scanned at the same time. In response to the scanning enable signals, the scanning clock generating circuits 104A and 104B generate scanning clock pulses for the upper and lower display areas, respectively. In contrast, during the partial-scanning period 14 during which only the upper display area is scanned as shown in FIG. 1, the scanning enable signal for the lower display area is held in a "0" (disable) state wherein the scanning clock generating circuit 104B stops generating the scanning clock pulses for the lower display area. During this time, the reset pulse generating circuit 103B operates to hold a data reset pulse for the lower display area in a "1" (reset) state. In response to a data reset pulse of the 1 level, a lower-display-segment driving circuit 6 converts all the bit data into dummy data representing "white", and outputs the white information signal having the waveform 15 is shown in FIG. 1.

Various waveforms of information signals may be utilized as dummy signals. For example, information signals representing "white" or "black" may be applied to all the signal lines, or information signals representing "white" and "black" may also be alternately applied to the signal lines. Information signals representing the same color may be applied to the corresponding portions in the upper and lower display areas. In any case, it has been found that contrast differences do not occur between the images displayed in the upper and lower display areas, whereby the quality of the displayed image is improved.

In the above explanation, the partial scanning of the upper display area has been referred to. However, it is clear that during a partial-scanning period in which the lower display area is scanned, the dummy information signals as described above are applied to the signal electrodes of the upper display area.

Figure 7:
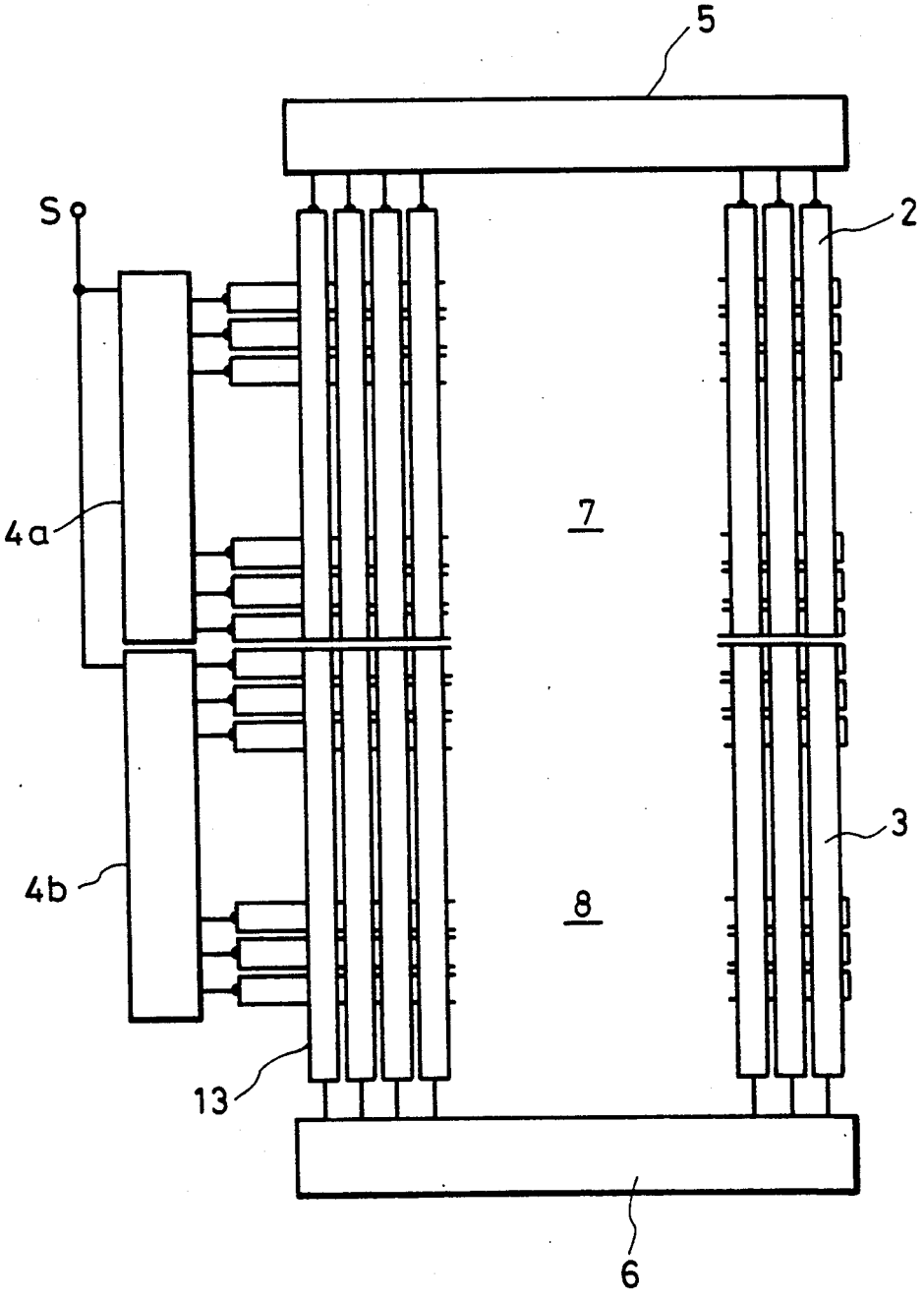
FIG. 7 is a partial schematic view of an apparatus having scanning and signal electrode driving circuits.
Figure 8:
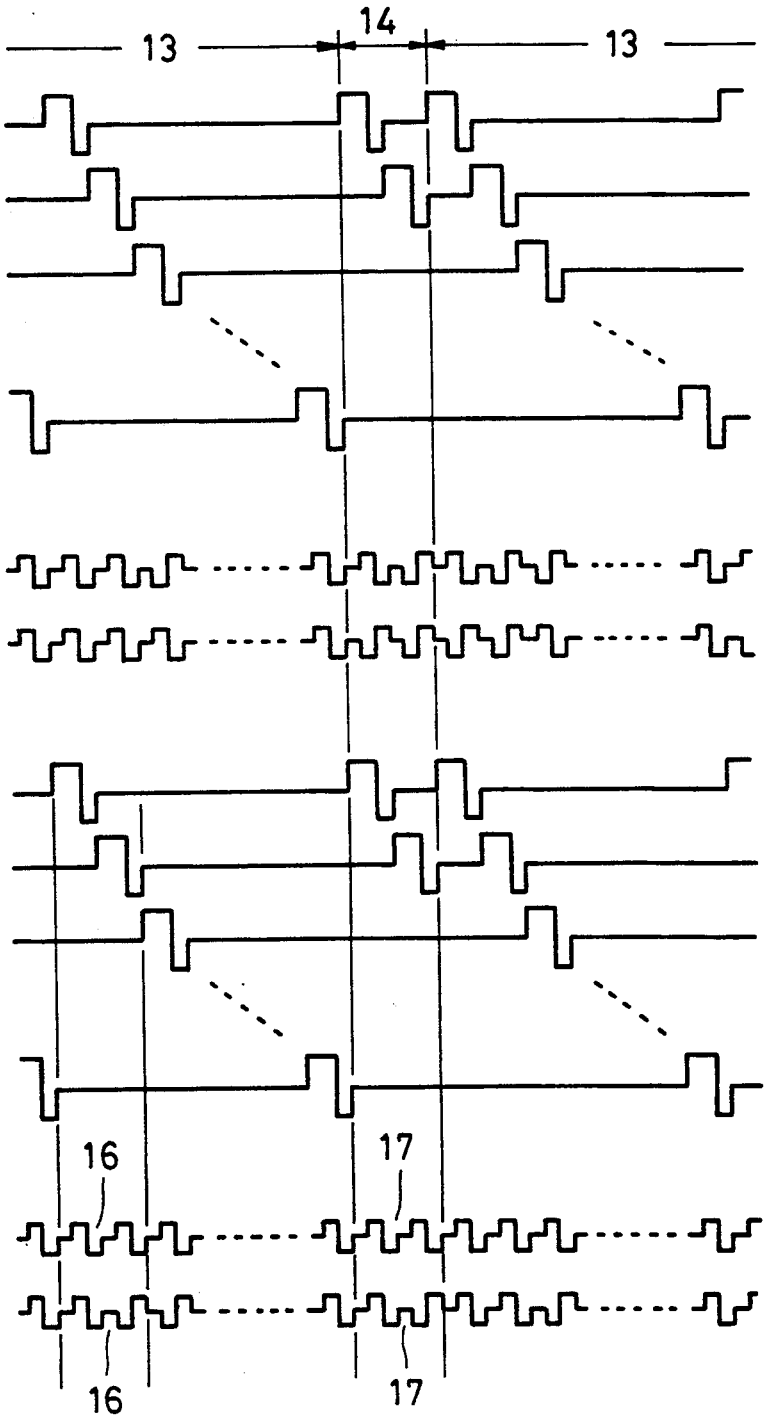
FIG. 8 is a timing chart showing a set of drive pulses in a method of driving a ferroelectric liquid crystal apparatus in accordance with a second embodiment of the present invention.

In the above-described horizontally-split panel-like liquid crystal display apparatus it is preferable for the sake of convenience of the circuit arrangement that during the period in which the upper display area is partially scanned, scanning-electrode selecting pulses are applied to corresponding scanning electrodes in the lower display area. FIG. 7 illustratively shows an arrangement in which a scanning-electrode driving circuit consists of an upper scanning-electrode driving circuit 4a and a lower scanning-electrode driving circuit 4*b*, wherein a control signal S and other scanning-line address signals which control the operation of the driving circuits 4*a* and 4*b* are shared by upper scanning-electrode driving circuit 4*a* and lower scanning-electrode driving circuit 4*b*. In such an arrangement, if one of the scanning lines (scanning electrodes) in the upper display area 7 is selected, a corresponding scanning electrode in the lower display area 8 is also selected. In this arrangement, shown in FIG. 8 (as a second embodiment of the present invention) during the partial-scanning period 14 in which the upper display area 7 is scanned, an information signal pulse train 17 (which represents the same signal as an information signal pulse train 16 corresponding to the currently displayed image) may be applied to prevent a change in the contents displayed in a corresponding portion in the lower display area. In this manner, the contrast can be made approximately equal between the upper and lower display areas, as in the first embodiment.

Figure 9:
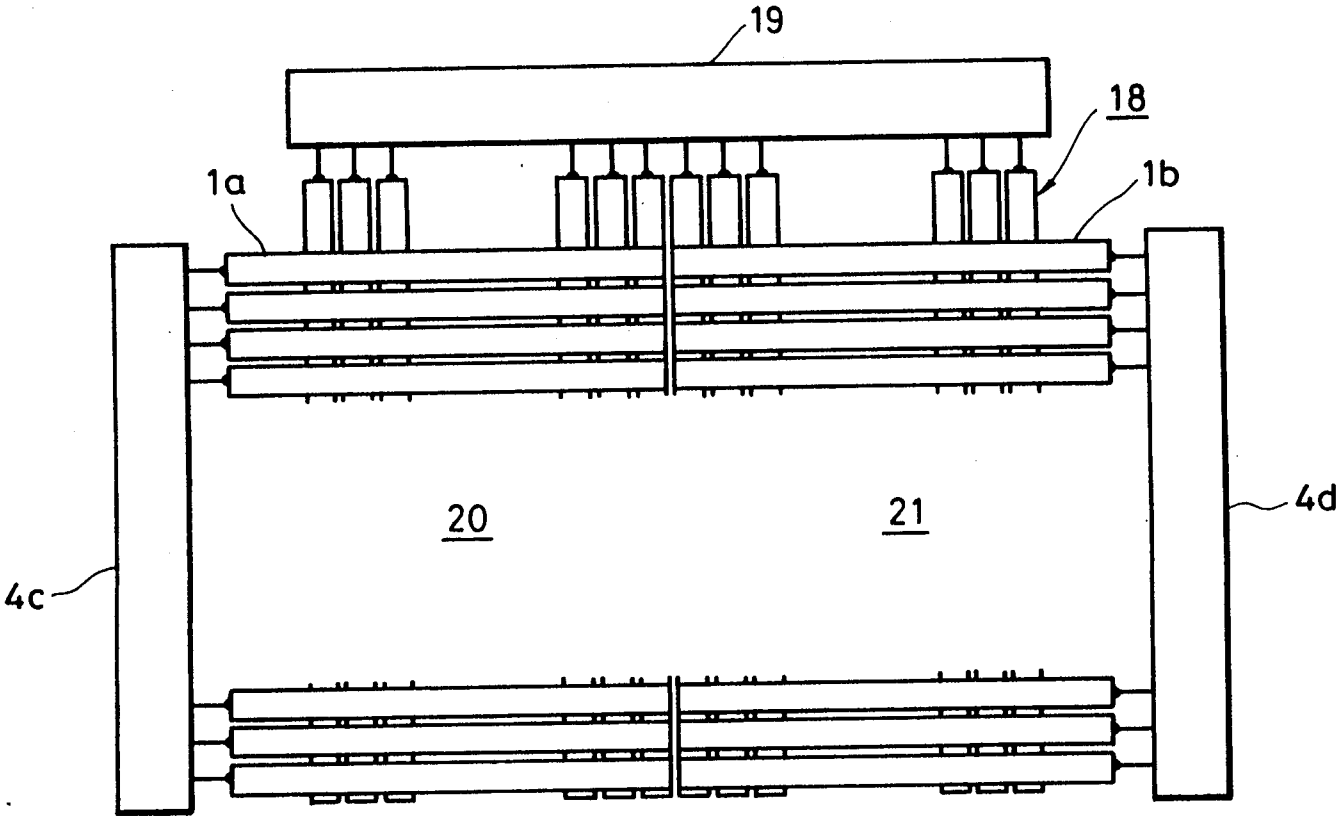
FIG. 9 is a partial schematic view showing a ferroelectric liquid crystal apparatus which is driven in accordance with a third embodiment of the present invention.

FIG. 9 is a schematic view showing a panel-like matrix display apparatus of the vertical split type to which a third embodiment of the present invention is applied wherein scanning electrodes are grouped into right-hand and left-hand display areas 21 and 20. This display apparatus is provided with a group of left-hand scanning electrodes 1*a*, a group of right-hand scanning electrodes lb, a scanning-electrode driving circuit 4c for driving the left-hand scanning electrodes la, a scanning-electrode driving circuit 4*d* for driving the right-hand scanning electrodes 1*b*, a group of signal electrodes 18 and a signal-electrode driving circuit 19. In this panel-like display apparatus, during the partial-scanning period for which the left-hand display area 20 is scanned, dummy information signal pulses are applied to the signal electrodes 20 in the right-hand display area 21, thereby maintaining as constant the contrasts of the images displayed in the right and left-hand display areas.

As is apparent from the foregoing, in accordance with the present invention, during a partial-rewriting (partial-scanning) period in which one display area of a display panel having two display areas is scanned, dummy signals are applied to the signal electrodes of the other of the two display areas, or the currently displayed contents are repeatedly displayed again in the other display area by corresponding scanning electrodes. Accordingly, the present invention makes it possible to effect partial scanning without any serious difference in contrast between the display areas, in order to obtain improved quality of the displayed image.

What is claimed is:

1. In a driving method for a matrix type ferroelectric liquid crystal apparatus which includes two separate display areas, each of the separate display areas comprising plural pixels arranged in a submatrix each having more than one row and one column, wherein the separate display areas are arranged to be driven independently, the improvement comprising the steps of:

scanning one of said separate display areas; and simultaneously applying a dummy signal to a signal electrode in the other of said separate display areas, wherein an image display in said other display area does not change, whereby a difference in contrast between and two separate display areas is minimized.

2. A driving method according to claim 1, wherein said dummy signal has a voltage waveform is an alternating current.

3. A driving method according to claim 1, wherein a voltage applied to a scanning electrode in which is not being scanned is the same as a voltage applied to a non-selected scanning electrode of the other display area which is being scanned.

4. A ferroelectric liquid crystal apparatus, comprising:

a first matrix electrode arrangement including a first group of scanning electrodes and a first group of signal electrodes, said first groups of scanning electrodes and signal electrodes crossing each other in oppositely spaced relationship;

an electrically independent second matrix electrode arrangement including a second group of scanning electrodes and a second group of signal electrodes, said second groups of scanning electrodes and signal electrodes also crossing each other in oppositely spaced relationship;

ferroelectric liquid crystal material interposed between both said first and second groups of scanning electrodes, and said first and second groups of signal electrodes;

driving means for driving said first and second matrix electrode arrangements; and controlling means for controlling said driving means to apply an alternating voltage to the portion of said ferroelectric liquid crystal positioned at the intersection points of one of said first and second groups of scanning electrodes and a corresponding one of said first and second groups of signal electrodes while the other group of scanning electrodes is being partially scanned, said alternating voltage being insufficient to switch said portion of said ferroelectric liquid crystal.

5. A ferroelectric liquid crystal apparatus, comprising:

a first matrix electrode arrangement including a first group of scanning electrodes and a first group of signal electrodes, said first groups of scanning electrodes and signal electrodes crossing each other in oppositely spaced relationship;

an electrically independent second matrix electrode arrangement including a second group of scanning electrodes and a second group of signal electrodes, said second groups of scanning electrodes and signal electrodes also crossing each other in oppositely spaced relationship;

ferroelectric liquid crystal material interposed between both said first and second groups of scanning electrodes, and said first and second groups of signal electrodes;

driving means for driving said first and second matrix electrode arrangements; and controlling means for controlling said driving means to apply, a scanning-electrode non-selecting signal to one group of scanning electrodes and to simultaneously apply a voltage signal to the group of signal electrodes which corresponds to said group of scanning electrodes while the other of said first and second groups of scanning electrodes is being partially scanned, said voltage signal producing an alternating voltage which is insufficient to switch said ferroelectric liquid crystal when said scanning-electrode non-selection signal is combined with said alternating voltage.

6. A ferroelectric liquid crystal apparatus, comprising:

a first matrix electrode arrangement including a first group of scanning electrodes and a first group of signal electrodes, said first groups of scanning electrodes and signal electrodes crossing each other in oppositely spaced relationship;

an electrically independent second matrix electrode arrangement including a second group of scanning electrodes and a second group of signal electrodes, said second groups of scanning electrodes and signal electrodes also crossing each other in oppositely spaced relationship;

ferroelectric liquid crystal material interposed between said first and second groups of scanning electrodes and said first and second groups of signal electrodes;

driving means for driving said first and second matrix electrode arrangements; and controlling means for controlling said driving means to apply an alternating voltage to the portion of said ferroelectric liquid crystal material which is positioned at each intersection point of one of said first and second groups of scanning electrodes and a corresponding intersection point of said first and second groups of signal electrodes while the other group of scanning electrodes is being partially scanned, wherein said alternating voltage is insufficient to switch said portion of said ferroelectric liquid crystal.

7. A ferroelectric liquid crystal apparatus, comprising:

a first matrix electrode arrangement including a first group of scanning electrodes and a first group of signal electrodes, said first groups of scanning electrodes and signal electrodes crossing each other in oppositely spaced relationship;

an electrically independent second matrix electrode arrangement including a second group of scanning electrodes and a second group of signal electrodes, said second groups of scanning electrodes and signal electrodes also crossing each other in oppositely spaced relationship;

ferroelectric liquid crystal material interposed between said first and second groups of scanning electrodes and said first and second groups of signal electrodes;

driving means for driving said first and second matrix electrode arrangements; and controlling means for controlling said driving means to apply, a scanning-electrode non-selecting signal to one of said first and second groups of scanning electrodes and simultaneously to apply a voltage signal to the group of signal electrodes which corresponds to said one group of scanning electrodes while the other of said groups of scanning electrodes is being partially scanned, said voltage signal producing an alternating voltage insufficient to switch said ferroelectric liquid crystal even when said scanning-electrode non-selection signal is combined with said alternating voltage.

8. In a driving method for a matrix-type ferroelectric liquid crystal apparatus which includes two separate display areas, each of the separate display areas comprising plural pixels arranged in a submatrix having more than one row and one column, wherein the separate display areas are arranged to be driven independently, the improvement comprising the steps of:

effecting partial scanning of one display area to partially rewrite the contents displayed in said selected display area, while partially scanning to corresponding scanning lines in the other display area; and simultaneously applying an information signal to corresponding signal electrodes of said other display area to hold the contents currently displayed in other display area.

9. A ferroelectric liquid crystal apparatus, comprising:

a liquid crystal device having a first matrix electrode arrangement including a first group of scanning electrodes and a first group of signal electrodes;

an independent second matrix electrode arrangement including a second group of scanning electrodes and a second group of signal electrodes, and a ferroelectric liquid crystal material located between said first group of scanning and signal electrodes and also between said second group of scanning and signal electrodes; and means for partially scanning one of said first and second matrix electrode while applying dummy signals which do not change the image display to signal electrodes to the other of said first and second matrix electrode arrangements, whereby a difference in contrast between said two independent matrix areas is minimized.

10. A ferroelectric liquid crystal apparatus, comprising:

a liquid crystal apparatus having a first matrix electrode arrangement including a first group of scanning electrodes and a first group of signal electrodes, an independent second matrix electrode arrangement including a second group of scanning electrodes and a second group of signal electrodes, and ferroelectric liquid crystal material located between the scanning and signal electrodes; and means for simultaneously scanning only (i) scanning electrodes in said first matrix electrode arrangement which correspond to a partial scanning area in which the contents displayed are to be altered and (ii) scanning electrodes in said second matrix electrode arrangement which correspond to a partial scanning area in which the contents displayed are not to be altered.

* * * * *

UNITED STATES PATENT AND TRADEMARK OFFICE

CERTIFICATE OF CORRECTION

PATENT NO. : 5,136,282

DATED : August 4, 1992

INVENTOR(S) : YUTAKA INABA, ET AL.

It is certified that error appears in the above-identified patent and that said Letters Patent is hereby corrected as shown below:

COLUMN 1

Line 26, "its" should be deleted.

COLUMN 5

Line 16, "are" should read --area are--.

COLUMN 7

Line 42, "and" should read --said--.
Line 48, "in which" should read --in one of said display areas which--.

COLUMN 8

Line 33, "apply," should read --apply--.

COLUMN 9

Line 26, "apply," should read --apply--.

--

UNITED STATES PATENT AND TRADEMARK OFFICE

CERTIFICATE OF CORRECTION

PATENT NO. : 5,136,282

DATED : August 4, 1992

INVENTOR(S) : YUTAKA INABA, ET AL.

It is certified that error appears in the above-identified patent and that said Letters Patent is hereby corrected as shown below:

COLUMN 10

Line 1, "to" should read --the--.
Line 6, "other" should read --said other--.
Line 20, "electrode" should read --electrode arrangements--.

Signed and Sealed this

Nineteenth Day of October, 1993

Bruce Lehman

*Attest:*

BRUCE LEHMAN

*Attesting Officer*

*Commissioner of Patents and Trademarks*